US005836098A

United States Patent [19]

Carney

[11] Patent Number: 5,836,098

[45] Date of Patent: Nov. 17, 1998

[54] FILE POSITION LOCATION DEVICE AND METHOD RELATED THERETO

[76] Inventor: Joseph T. Carney, 111 Hayes Ave., Charleston, W. Va. 25314

[21] Appl. No.: 791,214

[22] Filed: Jan. 31, 1997

[51] Int. Cl.[6] ..... G09F 3/16

[52] U.S. Cl. ..... 40/666; 40/359; 40/600; 40/641; 116/234; 281/42

[58] Field of Search ..... 40/1, 359, 600, 40/641, 666; 116/234, 236, 237, 238, 239; 248/206.5; 281/42

[56] References Cited

U.S. PATENT DOCUMENTS

| | | | |
|---|---|---|---|
| D. 331,598 | 12/1992 | Martin | D19/32 |
| 934,970 | 9/1909 | Inman | 116/238 |
| 1,294,948 | 2/1919 | Rand | 40/360 |
| 1,364,560 | 1/1921 | Kunkel | 40/666 |
| 1,596,225 | 8/1926 | Andersson | 281/42 X |
| 2,557,399 | 6/1951 | Teetor . | |
| 2,613,104 | 10/1952 | Parsons | 248/206.5 X |
| 3,195,022 | 7/1965 | Staver | 248/206.5 X |
| 3,229,820 | 1/1966 | Hentzi et al. . | |
| 3,286,381 | 11/1966 | Wooge | 40/641 |
| 3,291,429 | 12/1966 | Neanhouse | 248/206.5 |
| 4,031,646 | 6/1977 | de Nouël . | |
| 4,287,676 | 9/1981 | Weinhaus . | |
| 4,800,662 | 1/1989 | Belrose | 40/426 |
| 4,830,321 | 5/1989 | Irie . | |
| 4,982,685 | 1/1991 | Abe . | |
| 5,267,763 | 12/1993 | Klein | 248/206.5 X |
| 5,460,305 | 10/1995 | Ahern | 248/206.5 X |
| 5,513,459 | 5/1996 | Schneider . | |
| 5,613,602 | 3/1997 | Lage et al. | 40/666 X |
| 5,676,439 | 10/1997 | Occhipinti et al. | 40/666 X |

FOREIGN PATENT DOCUMENTS

| | | | |
|---|---|---|---|
| 2512470 | 10/1976 | Germany | 248/206.5 |

*Primary Examiner*—Kenneth J. Dorner
*Assistant Examiner*—Andrea Chop
*Attorney, Agent, or Firm*—Robert N. Blackmon

[57] ABSTRACT

A file position location device and related method are provided. The device permits easy location of the position from where a file has been removed from within a cabinet drawer. The device is easily stored on a metallic surface of the cabinet during non-use. The device has a magnetic substrate layer and a wedge shaped body adhered thereto. The magnetic substrate permits retention of the device on the surface of the cabinet for storage and ready availability when use is desired. The wedge shaped body when positioned between two non-removed files acts to resist downward gravitational forces to maintain the location of the device near the top of the drawer for visibility. The device may optionally have a clip to further ensure that the device is located near the top of the drawer during use and is not unintentionally permitted to move toward the bottom of the drawer out of view of the user. Preferably the wedge is made of an elastomeric polymeric foam to permit compression thereof between two non-removed files to enhance the resistance of the device to downward gravitational forces.

4 Claims, 1 Drawing Sheet

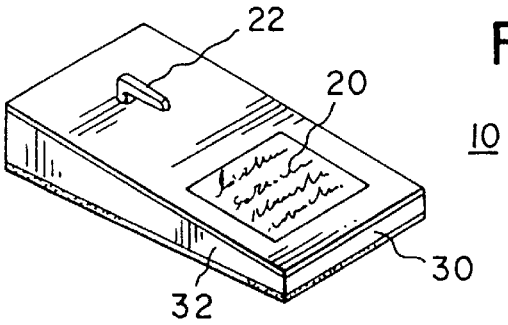
FIG. 1
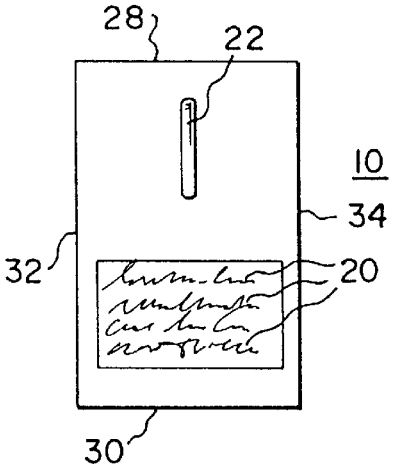
FIG. 2
FIG. 3
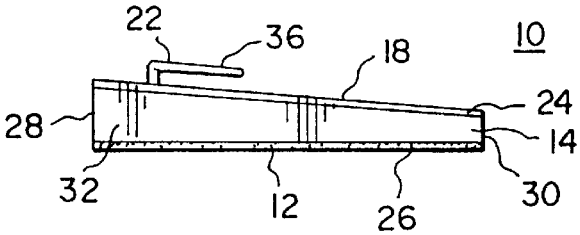
FIG. 4
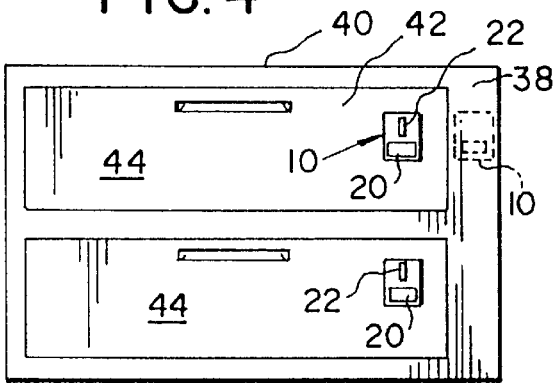
FIG. 6
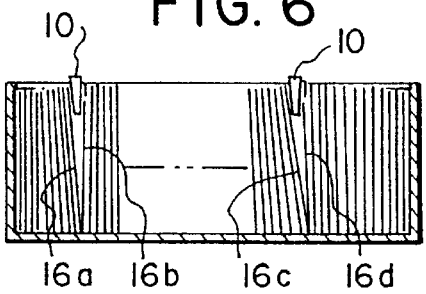
FIG. 5
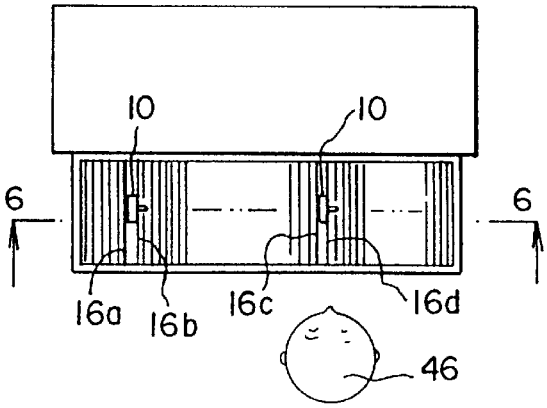

FILE POSITION LOCATION DEVICE AND METHOD RELATED THERETO

BACKGROUND OF THE INVENTION

1. Field of the Invention

The present invention relates to filing systems and related methods, and more particularly relates to file location systems and related methods.

2. Description of Related Art

The use of a magnetic layer with a non-magnetic layer is generally known, and such multi-layer structures have been used for refrigerator magnets and other signage. Other magnetic structure previously disclosed include:

Teeter U.S. Pat. No. 2,557,399 which disclosed a magnetic holder for display cards; Hans et al U.S. Pat. No. 3,229,820 which discloses a magnetic holder for tools; deNovel U.S. Pat. No. 4,031,646 which discloses a magnetic file folder; Weinhaus U.S. Pat. No. 4,287,676 which discloses a magnetically secured display apparatus having a display surface carried on a magnetic support structure; and Irie U.S. Pat. No. 4,830,321 which discloses a magnetic holder. Various structures have also been disclosed for marking positions in books see for example Abe U.S. Pat. No. 4,982,685 which discloses a clip-carrying book marker; and various structures have been disclosed for locating file positions see for example Schneider U.S. Pat. No. 5,513,459 which discloses a file system for locating files involving a plastic perpendicular file tab.

Generally, each of these structures has lacked one or more of the following properties: (a) they have lacked the desired structure for effectively providing file location characteristics, or (b) they have lacked magnetic characteristics or (c) they have lacked suitable surface characteristics for easy presentation of desired indicia.

Consequently, there is a desire for a structure which provides suitable structure for file position location, magnetic characteristics for easy storage on the outside of a metallic file cabinet, and a surface suitable for easy presentation of desired indicia.

SUMMARY OF THE INVENTION

A file position location device and related method are provided. The device permits easy location of the position from where a file has been removed from within a cabinet drawer. The device is easily stored on a metallic surface of the cabinet during non-use. The device has a magnetic substrate layer and a wedge shaped body adhered thereto. The magnetic substrate permits retention of the device on the surface of the cabinet for storage and ready availability when use is desired. The wedge shaped body when positioned between two non-removed files acts to resist downward gravitational forces to maintain the location of the device near the top of the drawer for viewability. The device may optionally have a clip to further ensure that the device is located near the top of the drawer during use and is not unintentionally permitted to move toward the bottom of the drawer out of view of the user. Preferably the wedge is made of an elastomeric polymeric foam to permit compression thereof between two non-removed files to enhance the resistance of the device to downward gravitational forces.

BRIEF DESCRIPTION OF THE DRAWINGS

FIG. 1 is a perspective view of the file position locating device of the present invention, FIG. 2 is a top plan view of the device of FIG. 1, FIG. 3 is a side elevational view of the device of FIG. 1, FIG. 4 is a front elevational view of a file cabinet having the device of FIG. 1 stored thereon, FIG. 5 is a top plan view of a cabinet having an open drawer with a device of the present invention positioned therein between two non-removed files, and FIG. 6 is a vertical cross-sectional view of the drawer of FIG. 5 taken along lines 6—6.

DETAILED DESCRIPTION OF THE INVENTION

A file position location device (10) is provided comprising (a) a magnetic substrate (12) and (b) a wedge shaped body (14) affixed to the substrate (12). The wedge body (14) permits the device (10) to resist downward movement when positioned between two non-removed files **(16*a,b,c,d*). The device (10) preferably has a superstrate layer (18) having indicia (20) thereon, and optionally may have clip means (22) for clipping the device to a non-removed file (16*b*)**.

The wedge (14) preferably has a rectangular top surface (24), a rectangular bottom surface (26) spaced apart from the top surface (24), a rectangular rear side (28), a rectangular forward (front) side (30) parallel to and spaced apart form the rear side (28), a trapezoidal left side (32) and a trapezoidal right side (34), wherein the left side (32) is parallel to and space apart from the right side (34). The front side (30) has a smaller area than the rear side (28) thereby providing the body (14) with a wedge shape.

The superstrate (18) is preferably rectangular and overlays and is adhered to the top surface (24) of the wedge (14). The clip means (22) preferably extends outwardly from the superstrate (18) and preferably has a finger (36) which has a biased position adjacent the superstrate for holding a panel (a file **(16*b*) between the finger (36) and the superstrate (18)**. The clip means may be similar to the clips found on conventional ball point pins (not shown) and may made of be metal or plastic.

As best shown in FIG. 4, the device (10) may be stored by on the outside (38) of a cabinet (40) by placing the magnetic substrate (12) of the device (10) into contact with the metal outside (38) of the cabinet (40). The magnetic forces of the substrate (12) provide sufficient attraction between the device (10) and the cabinet (40) to overcome gravitational forces and to permit the device (10) to be stored on the outside (38) of the cabinet (40), readily available for use.

The cabinet (40) has a least one drawer (42) which may be closed as best shown in FIG. 4, or may be opened as best shown in FIG. 5. The device (10) may be stored on the face (44) of the drawer (42) as shown in FIG. 4. When the device (10) is in the stored position on the outside, preferably the front, of the cabinet, the indicia (20) on the superstrate (18) of the device (10) is readily viewable. The indicia (20) may be in the form of advertising, such as advertising for office supplies, so that when additional file folders are needed, the telephone number for ordering the files will be readily available and viewable. Alternatively the indicia may include various instructions, file names or other information.

As best shown in FIG. 5 and 6, the device (10) may be placed in a position between two non-removed files **(16*a,b* or 16*c,d*) to mark the location where a file was removed from so that when the user of the file returns to the drawer (42) to replace the file in its original position, the user (46) can readily and easily locate the position for the returned file to be inserted in the drawer (42), and the user (46) may return the file to its correct location by placing the returned file in the position which was occupied by the device (10). The device (10) may then be returned to its stored position on the outside (38) of the cabinet (40). As shown in FIG. 5 and 6, the device (10) between non-removed files (16***a,b*) has an optional finger (36) which clips on to the file (16*b*) for further resisting gravitational forces, and the device (10) between non-removed files (16*c,d*) does not have a finger.

Preferably, the magnetic substrate material is a thin sheet of flexible magnetic material as is commonly used for refrigerator magnets, and suitable materials are vinyl materials having magnetic materials dispersed therethrough such as commercially available materials sold under the trademark "ULTRAMAG" from Flex-Mag Industrial, Inc., a Division of Dyanacast co., Marietta, Ohio.

Preferably, the indicia bearing superstrate material may suitably be a polymeric sheet such as polyvinylchloride sheet material.

Preferably the wedge body material is an elastomeric foam material and may be in the nature of a rubber type foam. Suitable types of rubber foams include polybutadiene type rubber foams and copolymer (SB, SBS) rubber foams.

Suitable adhesives for adhering the superstrate and substrate to the body include conventional adhesives. The indicia may be placed on the superstrate by conventional processes.

A suitable device (10) would have a superstrate having a thickness of 10 mils and a rectangular shape having dimensions of 1.5 inches by 4 inches, a suitable substrate would have the same dimensions and thickness, and the wedge body could have a suitable thickness of 0.25 inches at the rear side tapering down to 0.125 inches at the front side.

What is claimed is:

1. A method for locating the position of a file, said method comprising:

(a) storing files in a file storage cabinet having a file drawer and having a metal surface, (b) providing a file position location device comprising (i) a magnetic substrate, and (ii) a foam wedge adhered to said substrate;

(c) magnetically attaching said device to said cabinet by placing said magnetic substrate into contact with said metal surface, (d) opening said drawer, (e) removing a file from said drawer, said file having had a position between two non-removed files, (f) placing said device in said position between said two non-removed files, wherein said wedge of said device comprises a compressible, elastomeric polymeric foam for permitting compression of said wedge by forces applied by said non-removed files;

(g) closing said drawer, (h) opening said drawer to replace said file in the position of said device.

2. The method of claim 1 wherein said device has a polymeric superstrate adhered to a top surface of said wedge, said superstrate having a top surface having indicia thereon.

3. The method of claim 1 wherein said device comprises clip means for clipping said device onto said non-removed files.

4. The method of claim 1, wherein said wedge comprises indicia viewable when said device is attached to said cabinet.

* * * * *